United States Patent [19]

Plummer

[11] Patent Number: 4,600,454

[45] Date of Patent: Jul. 15, 1986

[54] METHOD OF MAKING AND USING A SHIELDED RE-ENTERABLE JACKET WITH DIELECTRIC SPACER

[76] Inventor: Walter A. Plummer, 14831 Foxcroft Rd., Tustin, Calif. 92680

[21] Appl. No.: 723,499

[22] Filed: Apr. 15, 1985

Related U.S. Application Data

[62] Division of Ser. No. 587,590, Mar. 8, 1984, Pat. No. 4,572,922.

[51] Int. Cl.[4] ..... H01B 13/22

[52] U.S. Cl. ..... 156/55; 156/56; 156/227; 156/250; 174/36; 428/176

[58] Field of Search ..... 156/52–56, 156/227, 250; 174/36; 428/175, 247, 255, 176, 107–110

[56] References Cited

U.S. PATENT DOCUMENTS 3,582,532 6/1971 Plummer ..... 174/36
4,409,427 10/1983 Plummer ..... 174/36
4,461,076 7/1984 Plummer ..... 156/54 X
4,503,114 3/1985 Cohen ..... 428/247

*Primary Examiner*—Robert A. Dawson
*Attorney, Agent, or Firm*—Sellers and Brace

[57] ABSTRACT

Disclosed is a unitary re-enterable shielded jacket assembly for a plurality of insulated conductors provided with a dielectric spacer of nonconductive netting arranged and effective to provide a layer of air cells between the jacket shielding and the embraced conductors thereby to stabilize the impedance of the cable assembly from end to end thereof. One lateral edge of the dielectric spacer is attached to the jacket adjacent the inner shielding layer thereof and is sufficiently wide for its opposite edges to overlap when the jacket seam is closed. The dielectric spacer may be pleated lengthwise thereof to provide pockets for separate ribbon cables, the pleats being interconnected by hinges formed by groups of severed transverse strands which groups are separated by at least one unsevered transverse strand.

6 Claims, 5 Drawing Figures

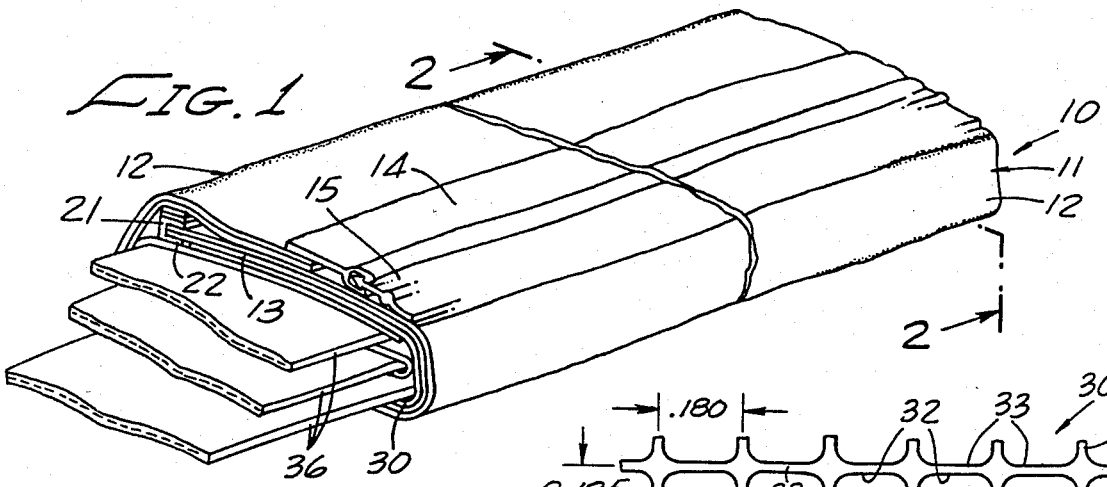
FIG. 1
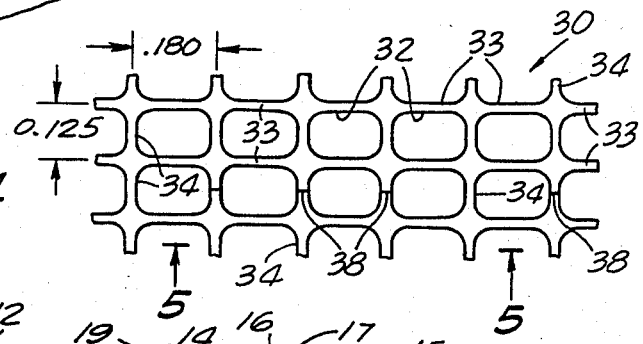
FIG. 4
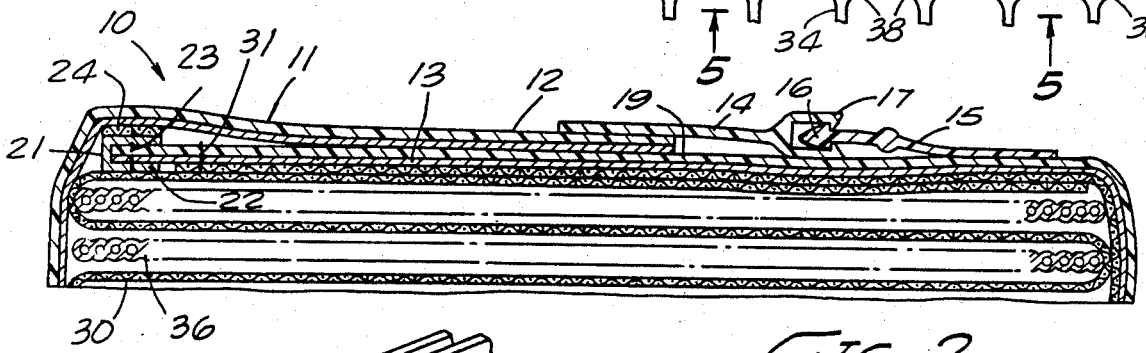
FIG. 2
FIG. 5
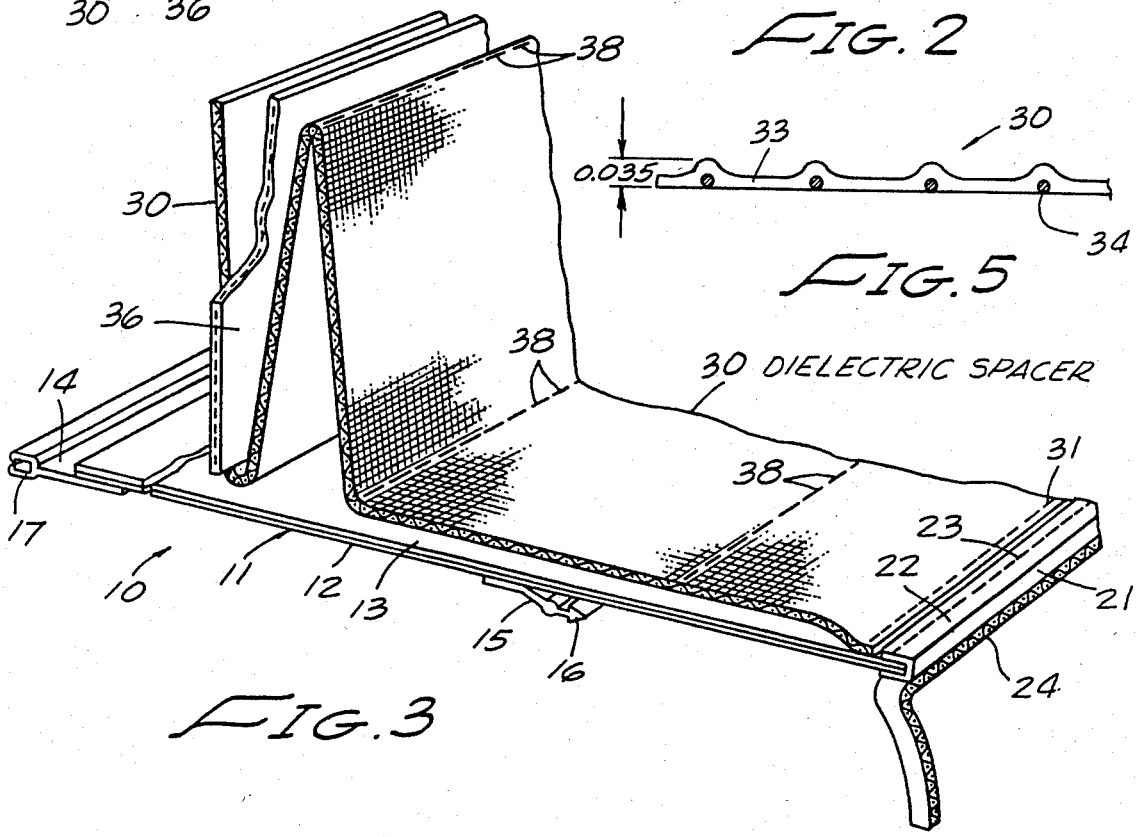
FIG. 3

METHOD OF MAKING AND USING A SHIELDED RE-ENTERABLE JACKET WITH DIELECTRIC SPACER

This application is a division of my copending application for U.S. Pat. Ser. No. 587,590 filed Mar. 8, 1984 entitled SHIELDED RE-ENTERABLE JACKET WITH DIELECTRIC SPACER, now U.S. Pat. No. 4,572,922.

This invention relates to shielded jacketing for cabling, and more particularly to a novel re-enterable shielded jacket equipped with dielectric spacer fixed to the jacket and arranged between the jacket shielding and the insulated conductors which spacer may be pleated to provide pockets for separate ribbon cables to maintain them dielectrically separated from one another and from the jacket shielding.

BACKGROUND OF THE INVENTION

It is known that low amplitude signals handled by multiple conductors within shielded jacketing pose problems arising from variable impedance of the cable assembly as well as from cross talk between conductors which can be eliminated or practically inhibited by appropriate provision for lateral spacing between the cable shield and the conductors and by properly spacing the conductors from one another. Certain proposals have been made to accomplish these objectives but these are subject to various shortcomings and objections owing to the multiplicity of components to be assembled and the difficulty and labor time required to accomplish the assembly. For example, it has been proposed to employ a separate non-conductive dielectric spacer element between each adjacent pair of ribbon cables but it is difficult and time consuming to assemble these components and to maintain them in their desired relative positions while enclosing them within a shielded outer enclosure.

SUMMARY OF THE INVENTION

The foregoing and other shortcomings of prior proposals for reducing crosstalk and for inhibiting variations in the rated impedance of the cable assembly lengthwise thereof by providing a simply constructed unitary re-enterable jacket assembly equally suitable and effective for use with a bundle of conductors or with one or more superimposed ribbon cables. When so employed the dielectric spacer is folded into accordion pleats forming cells each chargeable with a separate ribbon cable, the arrangement being such that when the jacketing is closed each ribbon cable is separated from another by the spacer and each lateral edge of the ribbon cables is likewise separated from the shielding layer of the jacket by a layer of the spacer. The spacer provides a dielectric layer of minimum thickness between all conductors and the shielding thereby inhibiting crosstalk between adjacent cables and providing a cable assembly of constant rated impedance. Folding of the dielectric spacer along desired hinge axes is facilitated by slitting groups of transverse strands of the spacer to either side of unsevered transverse strands. Typically, the hinge axes are spaced apart by the transverse width of the ribbon cables to be maintained spaced from one another. In all cases the width of the spacer is sufficient for the opposite lateral edges to overlap one another when the jacketing is assembled by closing a separable seam extending lengthwise thereof. All components are secured together in a unitary assembly including a jacket guard flap having a width at least bridging the separable claim components and preferably approximately as much as one-fourth the girth of the jacketing. The edge of the guard flap is provided with an overturned strip of conductive material embracing its edge to the outer leg of which a flexible grounding lead is secured.

In view of the foregoing, it is a primary object of this invention to provide a unique re-enterable shielded cabling jacket and method of making the same having attached thereto a dielectric spacer arranged to maintain all conductors spaced a predetermined minimum distance from the jacket shielding and cooperating therewith to maintain the cable rated impedance constant.

Another object of the invention is the provision of an improved method and unitary article of manufacture for enclosing a plurality of conductors in a shielded re-enterable enclosure and dielectrically isolated from the shielding by a spacer providing an air layer of predetermined thickness.

Another object of the invention is the provision of a dielectric spacer formed by spaced apart strands crisscrossing one another at right angles and foldable into accordion pleated configuration by hinges formed by groups of slit transverse strands separated from one another by one or more unsevered transverse strands.

Another object of the invention is the provision of a re-enterable cable shielding jacket of one piece unitary construction provided with a dielectric spacer anchored along one lateral edge thereof to the interior of the jacket and sufficiently wide transversely of the jacket to have its lateral edges overlap when the jacketing is assembled to cabling.

These and other more specific objects will appear upon reading the following specification and claims and upon considering in connection therewith the attached drawing to which they relate.

Referring now to the drawing in which a preferred embodiment of the invention is illustrated:

FIG. 1 is a fragmentary perspective view of an illustrative embodiment of the invention jacketing assembled about a plurality of superimposed ribbon cables;

FIG. 2 is a partial cross sectional view on an enlarged scale taken along line 2—2 on FIG. 1;

FIG. 3 is a perspective view showing the jacketing open with the dielectric spacer partially folded into an accordion pleated configuration and showing one ribbon cable in place;

FIG. 4 is a fragmentary plan view on a magnified scale showing a portion of the dielectric spacer and also showing a portion of the hinge interconnecting adjacent panels of the pleating; and FIG. 5 is a cross sectional view taken along line 5—5 on FIG. 4.

An illustrative embodiment of the invention jacketing is shown in FIGS. 1–5 and is designated generally 10. This unitary assembly includes a re-enterable seamed jacket 11 having an outer layer of impervious non-conductive elastomeric material 12 and an inner layer 13 of conductive foil. As herein shown, the outer and inner layers 12, 13 are laminated to one another but the inner layer of conductive material may comprise one or more layers of fine mesh unattached thereto.

Jacketing 11 includes separable interlocking seam members 14, 15, the adjacent lateral edges of which interlock with one another, such as a barbed male member 16 adapted to interlock with the inwardly projecting barbs of the U-shaped female portion 17 extending along the edge of seam member 14. As herein shown, seam member 14 is fused or otherwise secured to the left hand lateral edge of jacket 11 whereas seam member 15 is secured to the left hand lateral edge of jacket 11 whereas seam member 15 is secured to the exterior of the other lateral edge of jacketing 11 along an area parallel to but spaced substantially to the right of the other lateral edge of the jacket. The distance between the right hand lateral edge of the jacketing and the point of attachment thereto of seam member 15 provides a guard flap 19 sufficiently wide to underlie and bridge the seam members when closed and preferably sufficiently wide to span approximately one-fourth the girth of the assembled jacketing.

Embracing the free edge of guard flap 19 is a U-shaped strip of conductive foil 21 having its inner leg 22 in intimate contact with the foil layer 13. Its outer leg is secured against the outer surface of the jacket elastomeric layer 11 by stitching or the like 23 which also serves to secure grounding lead 24 to the guard flap and in intimate conductive relation to the outer leg of foil strip 21.

Secured to the interior of jacketing 11 is a flexible dielectric spacer 30 formed in one unitary netlike structure of suitable insulation such as polyethylene reinforced vinyl or Dacron. Spacer 30 is at least sufficiently wide to encircle the interior of the jacketing with its opposite lateral edges overlappng and one of which edges is here shown as secured to the right hand edge of guard flap 19 by stitching 31. If the spacer is being used to separate plural cables from one another, it has a width very substantially in excess of the width of the open jacketing.

As herein shown the spacer is molded in one piece to form a multiplicity of air cells or passages 32. These cells, as herein shown are generally of rectangular configuration and formed by longitudinal strands 33 and transverse strands 34 lying at right angles thereto and integrally joined to one another at points of crossover. Excellent results for its intended purposes have been obtained when the distance between transverse strands is approximately 0.180 inches and the distance between longitudinal strands is 0.125 inches and the effective thickness of the spacer is 0.035 inches as determined by the high points on its opposite faces. The cross sectional diameters of both longitudinal and transverse strands are very substantially smaller than the spacer thickness determined by the 0.035 measurement. In consequence, it will be apparent that a very substantial blanket of air is assured between the opposite faces of the spacer, this blanket being 0.035 inches or about 35 mils thick.

An important feature of the dielectric spacer when used to embrace ribbon cables 36 is the provision of a hinge adjacent alternate edges of ribbon cables. A simply constructed and very satisfactory hinge is formed by slitting transverse strands 34 midway between a pair of adjacent longitudinal strands 33. Such slits are indicated at 38 in FIG. 4, there being a group of three adjacent slits separated from a similar adjacent group of slits by an unsevered transverse strand 34. A lesser or greater number of unsevered strands may be employed but a single non-severed strand between adjacent groups of three severed strands has been found to provide a hinge between pleats of adequate strength coupled with ease of foldability.

The mode of assembly and use of the invention shielded jacket will be readily apparent from the foregoing detailed description. If the width of the dielectric spacer 30 is to be used with a plurality of conductors its width is sufficiently greater than the width of the main body of the jacket as to provide an ample overlap when the conductors are enclosed by the jacketing, it being noted that all will then be spaced from the shielding layer 13 at least by the thickness of the spacer. If the jacketing is to be used to enclose plural ribbon cables 36 then a much wider spacer is employed, the width being adequate to provide the requisite number of cells for separate ribbon cables. Also when pleated, the spacer is preferably provided with a hinge interconnecting all pleats and formed by spaced apart groups of slits 38 to either side of an unsevered transverse strand as described above. The spacer is then folded as indicated in FIG. 3 and individual ribbon cables are enclosed in each of the cells between pleats to provide a flat flexible cable assembly which is re-enterable at any time to provide a compact assembly wherein crosstalk between ribbons is eliminated and the rated capacity of the cable remains constant.

While the particular shielded re-enterable jacket with dielectric spacer herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That method of processing flexible non-conductive plastic mesh material having longitudinal and transverse strands to facilitate the folding thereof into side-by-side pleats along a predetermined hinge axis for use to embrace and separate conductors from one another thereby to maintain the rated impedance therebetween substantially constant from end-to-end thereof when said nonconductive plastic mesh material is embraced by an electromagnetically shielded jacket which method comprises:

selecting a desired hinge axis lying between an adjacent pair of longitudinal strands; and severing groups of transverse strands which groups are in alignment and lie between said pair of strands and are separated from one another by at least one unsevered strand thereby to form a hinge.

2. That method defined in claim 1 characterized in the step of repeating said steps defined in claim 1 along one or more additional spaced apart hinge axes lying parallel to one another thereby to facilitate the folding of said plastic mesh material into similar accordion-like pleats.

3. That method defined in claim 2 characterized in the steps of inserting a separate set of ribbon cable conductors in the space between adjacent panels of said accordion-like pleated material, and securing said pleated material and said ribbon cables snugly together and effective to prevent cross talk between conductors of said ribbon cables when the same are installed in activated signal circuits.

4. That method defined in claim 1 characterized in the step of utilizing plastic mesh material provided with open ended unobstructed air cells delineated by and located between adjacent longitudinal and transverse strands.

5. That method defined in claim 4 characterized in the step of utilizing plastic mesh material provided with air cells having a thickness of at least 35 mils.

6. That method of preventing cross talk between a plurality of generally parallel conductors when installed in activated signal circuits which method comprises separating at least certain of said conductors from one another by a dielectric plastic mesh spacer having a multiplicity of closely spaced apart substantially unobstructed air passages each opening through the opposite sides thereof and which dielectric spacer has an effective thickness of at least 35 mils.

* * * * *